US006027303A

United States Patent [19]

Voegeli

[11] Patent Number: 6,027,303

[45] Date of Patent: Feb. 22, 2000

[54] NON-COUNTERWEIGHTED LIFT TRUCK AND METHOD OF OPERATION

[76] Inventor: Ronald C. Voegeli, 918 Gibbs Rd., Venice, Fla. 34285

[21] Appl. No.: 08/897,150

[22] Filed: Jul. 18, 1997

[51] Int. Cl.[7] ..... B66B 9/20

[52] U.S. Cl. ..... 414/673; 414/667; 414/671; 414/631; 414/629; 414/584; 414/401; 184/222

[58] Field of Search ..... 414/667, 664, 414/668, 672, 673, 662, 663, 620, 401, 584, 628, 631, 396, 719; 901/48; 254/2 R, 3 R; 187/222, 237, 234

[56] References Cited

U.S. PATENT DOCUMENTS

| | | | |
|---|---|---|---|
| 1,277,214 | 8/1918 | Hoster | 414/719 X |
| 1,307,448 | 6/1919 | Lerch | 414/719 |
| 2,992,751 | 7/1961 | Quayle | 414/668 |
| 3,754,512 | 8/1973 | Kmety | 414/584 X |
| 4,921,075 | 5/1990 | Schumacher et al. | 414/663 X |
| 5,374,156 | 12/1994 | Simpson et al. | 414/667 |

FOREIGN PATENT DOCUMENTS

| | | | |
|---|---|---|---|
| 48400 | 2/1990 | Japan | 414/667 |
| 800 5192 | 4/1982 | Netherlands | 414/664 |

*Primary Examiner*—Frank E. Werner
*Attorney, Agent, or Firm*—Burns, Doane, Swecker & Mathis, L.L.P.

[57] ABSTRACT

A lift truck, especially for lifting boats, includes a self-propelled main frame having a pair of parallel rails extending in a fore-and-aft direction. The main frame is supported by front drive wheels and rear castor wheels. A mast is movable forwardly and rearwardly on the rails and carries a lift assembly that can pivot about a transverse axis. The lift assembly includes a pair of lift arms each having vertical and horizontal portions. The vertical portions are mounted to swing about respective fore-and-aft axes, and are horizontally movable toward and away from one another for increasing or decreasing the distance between those axes. The main frame does not carry a counterbalance weight, but rather has a latch which grips a ground-mounted anchor for anchoring the rear end of the main frame during vertical movement of the lift assembly.

18 Claims, 7 Drawing Sheets

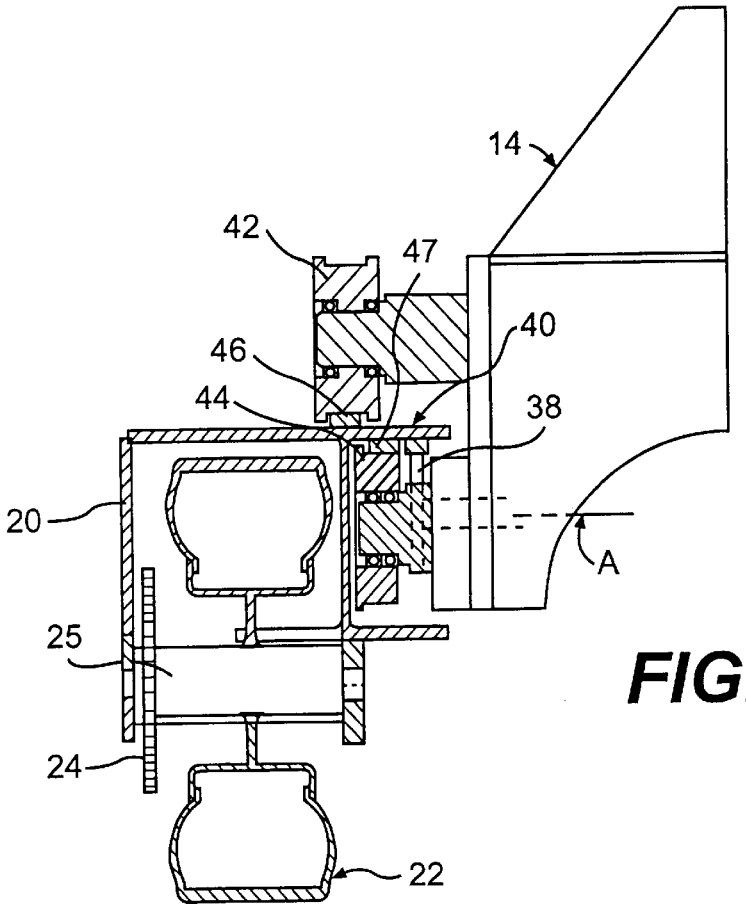
FIG. 3
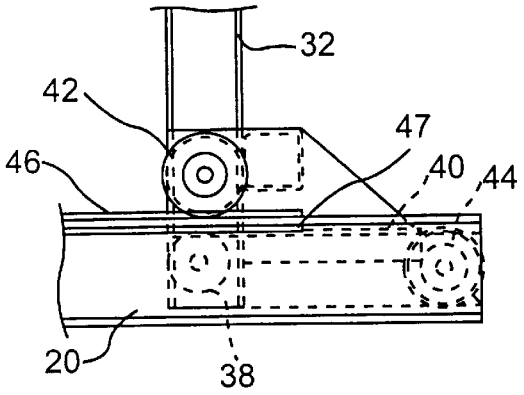
FIG. 4
FIG. 5
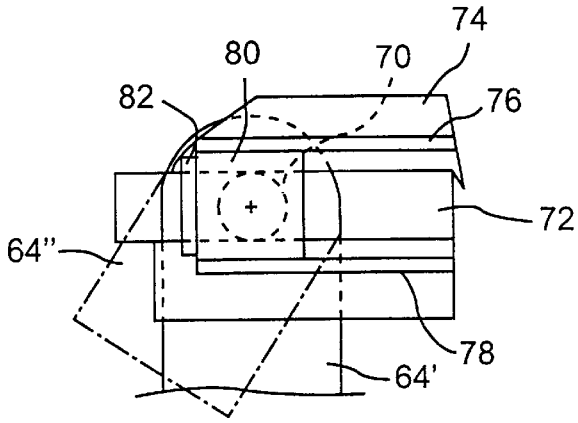

NON-COUNTERWEIGHTED LIFT TRUCK AND METHOD OF OPERATION

BACKGROUND OF THE INVENTION

The present invention relates to a lift truck and especially to a lift truck for raising, lowering and moving boats, and related methods.

For a number of reasons, including the shortage and high price of waterfront land, the need to store boats on land has increased. It has become common to store similarly sized boats, e.g., boats of 30–40 feet in length, in horizontal racks. The racks are made to retain boats side-by-side, bow in, stern out, one above the other.

It is also necessary to provide transport vehicles capable of transporting the boats between the water and the racks. One commonly used device is a large counter-balanced fork truck modified to support a boat. A fork truck with long forks will hold a boat from the stern of most any shape hull design by adjusting the spread of the forks. A fork lift truck is dependent upon the weight behind the forward wheels to counter the weight of the boat. Larger lifting capacity can be obtained by moving the counterbalance weight farther from the boat, and/or by increasing the weight of the counterbalance.

Increasing the fork lift capacity can create certain problems. That is, as capacity is increased, the overall weight and length of the fork lift is increased. Increased weight means higher cost for equipment, shipping, and handling. Also, thicker and costlier pathways for the lift truck are required. In addition, the aisles in the storage facilities must be widened in order to accommodate the increased truck length. Increased weight also reduces the stability of the truck as it travels, especially downhill.

In order to be able to pass beneath a boat, the lift arms must be swung so that a relatively large distance between the horizontal boat-gripping forks or rails is provided. It has been proposed to provide the lift arms with axes. However, it is difficult to achieve the substantial separation between the horizontal portions of the lift arms without making the vertical portions of the lift arms quite long. This increases the vertical height of the lift truck to the point where the ceiling of the storage facility may be damaged.

SUMMARY OF THE INVENTION

The present invention relates to a lift truck which comprises a self-propelled main frame having front and rear ends. The main frame includes a pair of parallel horizontal rails extending in a fore-and-aft direction, at least one rear ground support wheel located at a rear end of the main frame, and a pair of front ground support wheels disposed adjacent front ends of respective ones of the rails. The main frame further includes a latch disposed adjacent a rear end of the main frame and arranged to extend downwardly and grasp a ground-mounted hook for anchoring the rear end of the main frame. The lift truck further comprises a mast mounted on the rails for movement in a fore-and-aft direction along the rails. A first drive mechanism is provided for propelling the mast forwardly and rearwardly along the rails. A lift assembly is mounted on the mast for vertical movement relative thereto. The lift assembly includes a pair of lift arms each having a generally horizontal portion extending in the fore-and-aft direction. A second drive mechanism is provided for raising and lowering the lift assembly.

Preferably, an operator's station is mounted for fore-and-aft movement with the mast.

The lift arms are preferably rotatable together relative to the mast about a horizontal axis located rearwardly of front ends of the horizontal portions of the lift arms. The axis extends transversely relative to the fore-and-aft direction.

Each of the lift arms preferably includes a generally vertical portion swingable about a generally horizontal swing axis extending in a fore-and-aft direction. The lift arms are horizontally movable toward and away from one another for increasing and decreasing a distance between the swing axes.

The front ground wheels are preferably power driven, and there are preferably two rear ground support wheels. The rear ground support wheels comprise castor wheels each having a vertical post mounted in a sleeve for vertical movement relative to the sleeve and rotational movement relative to the sleeve about a vertical axis. A fluid conduit extends from an upper part of one sleeve to an upper part of the other sleeve and is filled with liquid. The liquid is transferrable from one sleeve to another to permit relative vertical movement of the castor wheels. A valve is provided for blocking liquid flow through the conduit to prevent upward movement of both castor wheels.

An actuating mechanism is provided for energizing the ground wheels. Preferably, a first part of the actuating mechanism is mounted on the operator's station, and a second part of the actuating mechanism is mounted on the main frame. The first and second parts become uncoupled from one another in response to forward movement of the mast, to prevent the drive wheels from being energized.

The invention also relates to a method of raising an object, such as a boat, comprising the steps of:

A. positioning a self-propelled main frame adjacent the object;

B. moving a mast forwardly along horizontal rails of the main frame toward the object;

C. causing lift arms attached to the mast to engage an underside of the object;

D. raising the lift arms to raise the object;

E. moving the mast and object rearwardly along the rails; and

F. prior to step D, anchoring a rear end of the main frame to the ground.

BRIEF DESCRIPTION OF THE DRAWING

The objects and advantages of the invention will become apparent from the following detailed description of preferred embodiments thereof in connection with the accompanying drawings in which like numerals designate like elements and in which:

FIG. 3 is a sectional view taken through a drive wheel of the lift truck;

FIG. 4 is a fragmentary side elevational view of a mechanism for supporting the mast on the main frame of the lift truck;

FIG. 5 is a fragmentary view of an upper end of a lift arm of a lift assembly mounted on the mast;

DETAILED DESCRIPTION OF PREFERRED EMBODIMENTS OF THE INVENTION

Figure 1:
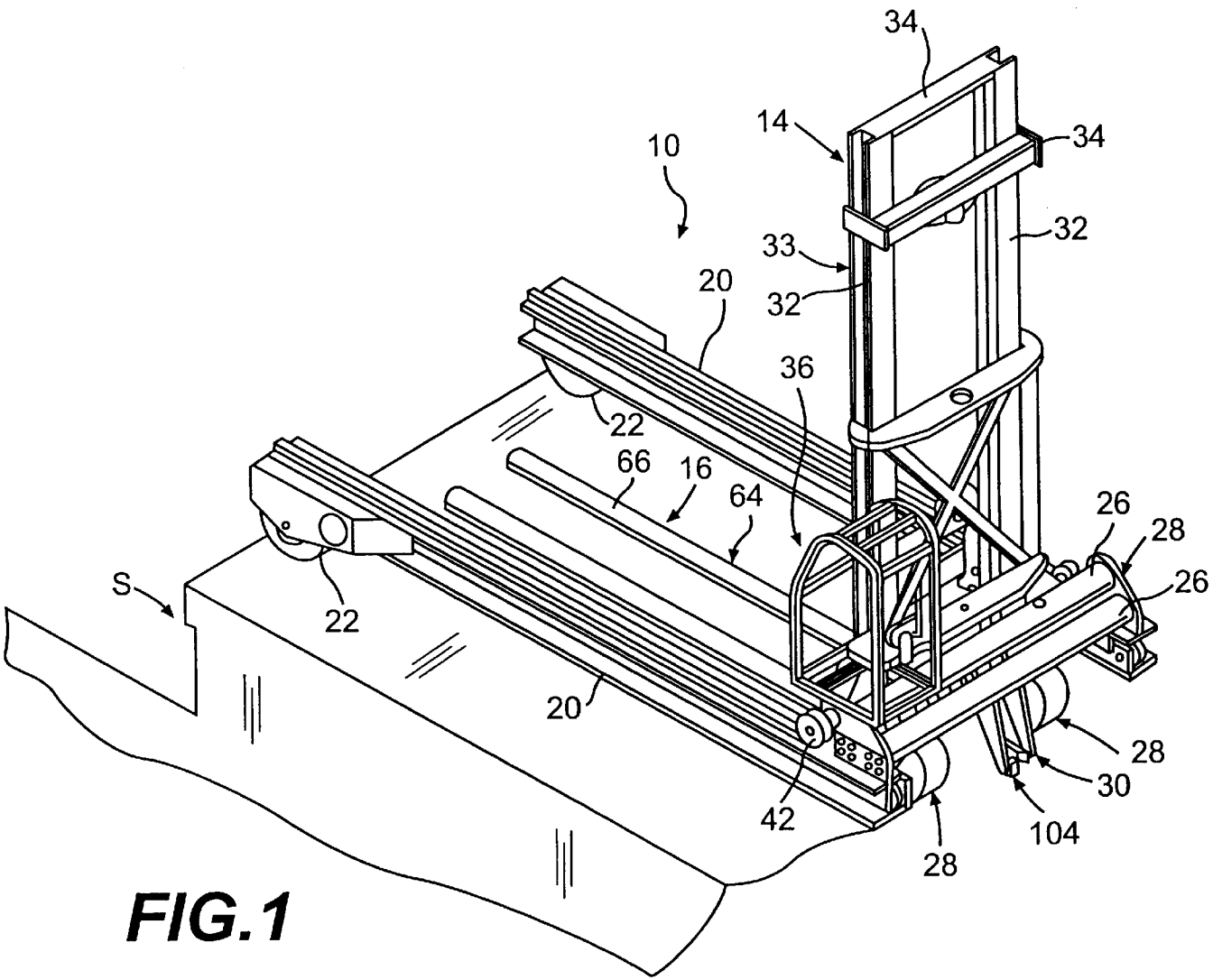
FIG. 1 is a top perspective view of a lift truck according to the present invention, with a mast thereof disposed in a rearward position, and the lift truck situated adjacent a sea wall.
Figure 2:
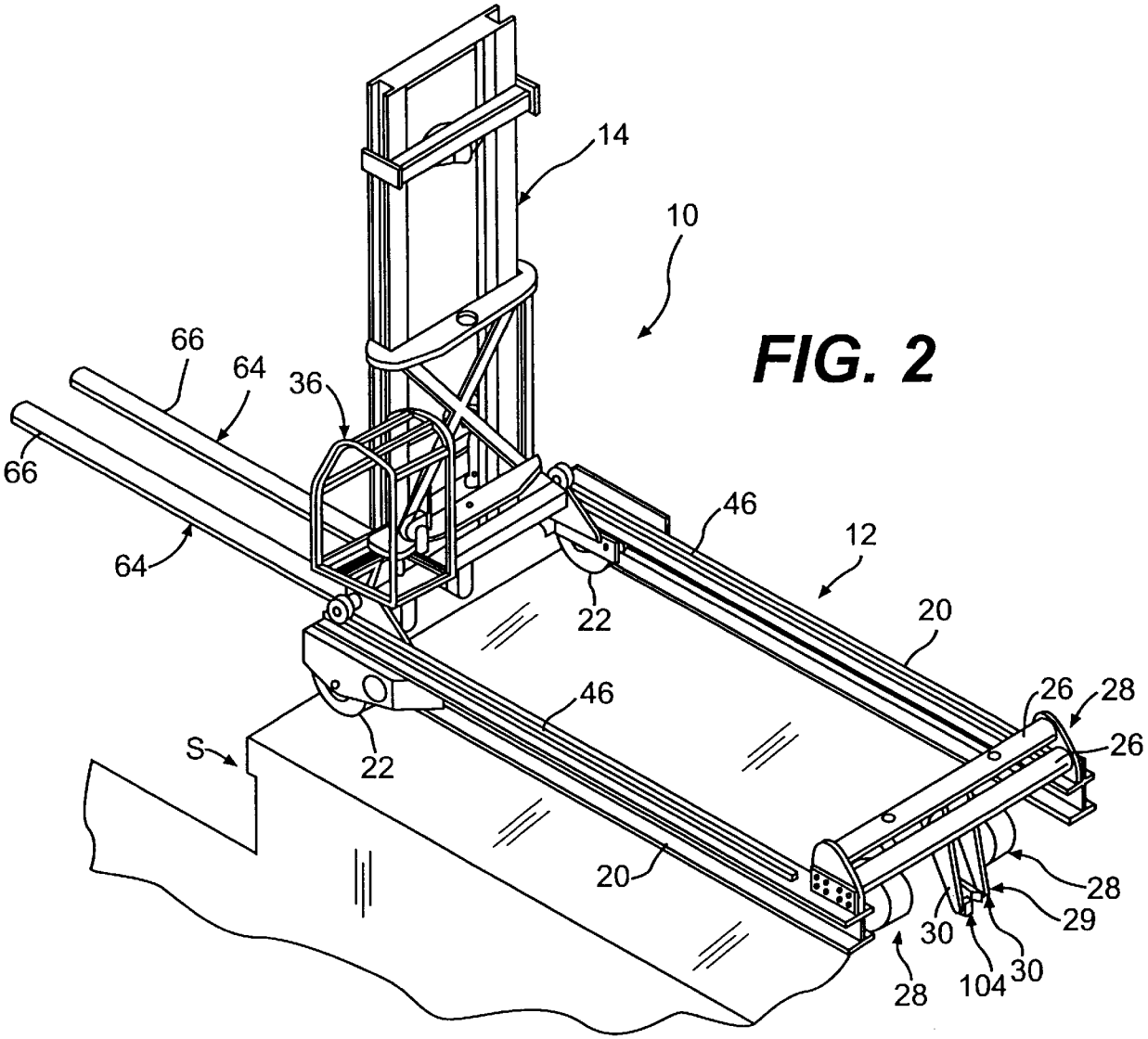
FIG. 2 is a view similar to FIG. 1 after the mast has been displaced forwardly.
Figure 6:
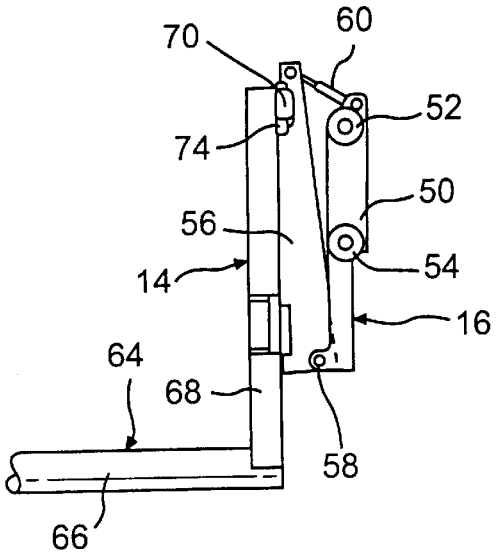
FIG. 6 is a side elevational view of a portion of the lift assembly.

A lift truck 10 shown in FIGS. 1 and 2 comprises a wheeled main frame 12, a horizontally movable mast 14 mounted on the main frame, and a lift assembly 16 mounted on the mast 14 for vertical movement relative thereto.

The lift truck can be employed to raise any suitable type of object, but is particularly useful in raising boats. As will be explained in detail, the lift truck 10 can be driven to the edge of a sea wall where a boat is floating, whereupon a rear end of the truck becomes temporarily anchored to the ground. The mast and lift assembly 14, 16 are advanced forwardly along the main frame 12. The lift assembly is lowered to grip the boat from beneath and is then raised to lift the boat from the water. The mast and lift assembly are then moved rearwardly along the main frame while supporting the boat. The main frame then becomes uncoupled from the ground and transports the boat to a storage facility (not shown).

Figure 7:
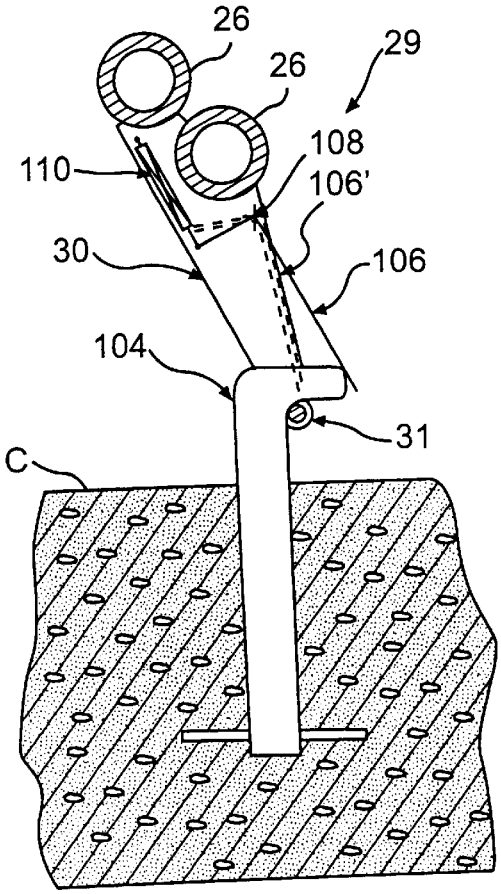
FIG. 7 is a vertical sectional view taken through a latch mechanism attached to the lift truck, with the latch mechanism connected to a ground mounted anchor.

The main frame 12 includes a pair of parallel horizontal rails 20. Mounted at the front end of each rail 20 is a drive wheel 22 driven by a respective hydraulic motor which is connected to a gear 24 affixed to an axle 25 of the wheel (see FIG. 3). The rails are interconnected at their rear ends by a rigid, transverse beam structure 27 comprised of a pair of torsion tubes 26. The rails could be welded to the tubes 26, but are preferably removably mounted to the tubes, e.g., by bolts to facilitate shipping. The rails are preferably hot-dip galvanized for protection against corrosion. Two castor wheels 28 are mounted on the beam 27 to support the rear end of the main frame. A latch 29 comprising two latch arms 30 and a latch pin 31 extending therebetween (see FIG. 7) is fixedly connected to the lower tube 26 and projects downwardly therefrom for reasons to be explained.

The mast 14 includes a mast frame 33 comprised of a pair of parallel vertical beams 32 interconnected by various cross braces 34. An operator's cab 36 is fixedly connected with the mast frame 33. From that cab, an operator controls the operations of the truck. Mounted at a lower end of the mast frame 33 are two mast propulsion wheels 38 driven about an axis A (one wheel shown in FIG. 3) by a hydraulic motor (not shown). Those propulsion wheels include radial projections (not shown) which engage in horizontally spaced holes formed along track elements 40 that are fixed to lower sides of the rails 20. Thus, by rotating the propulsion wheels 38, the mast 14 is moved forwardly or rearwardly along the main frame 12. Each of the tracks 40 can be in the form of a chain which is cut to length and affixed to a respective rail.

The mast frame 33 also carries pairs of free wheeling support wheels, each pair comprising horizontally spaced upper and lower support wheels 42, 44 (see FIGS. 3 and 4). The support wheels 42, 44 engage respective replaceable wear strips 46, 47 mounted on upper and lower sides of the rail to retain the mast 14 on the main frame.

The lift assembly 16 comprises a vertical lift frame 50 which carries a pair of guide wheels 52, 54 at each side thereof. The guide wheels 52, 54 are movable vertically along guide tracks (not shown) mounted on inner surfaces of the vertical beams 32 of the mast frame 33. Suitable fluid motors (not shown) are connected between the mast frame 33 and the lift frame 50 for raising and lowering the lift frame relative to the mast frame.

Mounted on the lift frame 50 is at least one upright plate 56. The plate 56 is connected to the lift frame 50 by a horizontal pivot pin 58 which forms a horizontal pivot axis for the plate 56. A hydraulic tilting cylinder 60 pivotably interconnects upper ends of the lift frame 50 and the plate 56 for tilting the plate 56 about the axis of the pin 58.

Figure 9:
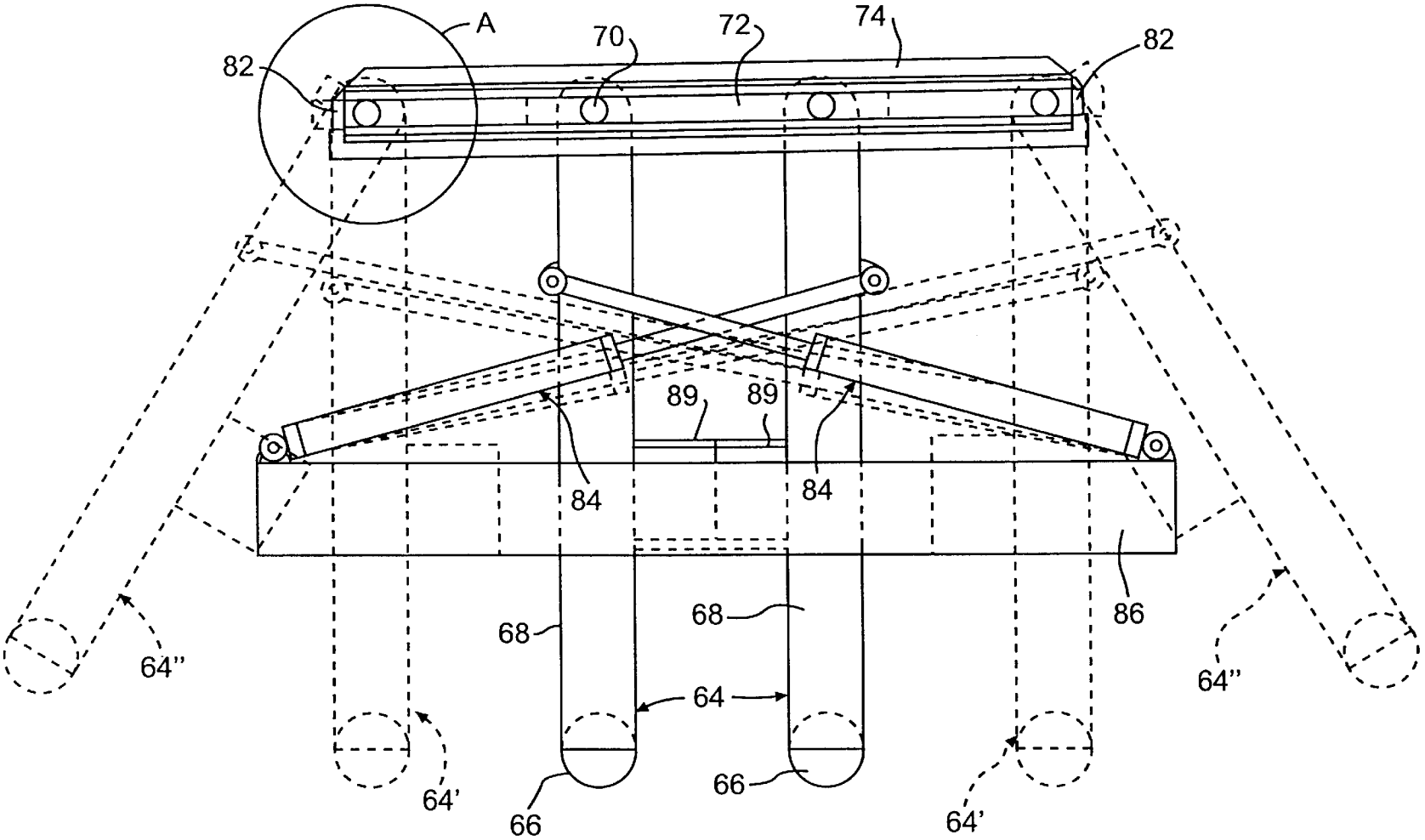
FIG. 9 is a rear elevational view of the lift assembly, depicting the lift arms in various positions of movement.

Carried by the plate 56 are a two boat lift arms 64, each of which including horizontal and vertical portions 66, 68. Each of the vertical portions 68 carries a horizontal pin 70 (see FIGS. 5 and 9) about which the vertical portion 68 is swingable. Each pin 70 passes through a slot 72 formed in a horizontal beam 74 that is affixed to the plate 56. On one side of the beam 74 there are disposed upper and lower guide strips 76, 78 disposed above and below the slot 72. The pin 70 carries a rectangular block 80 that is slidable in the slot 72 between the strips 76, 78.

Disposed at each end of the slot 72 is a stop 82. Connected to the vertical portions 68 of the lift arms are respective hydraulic cylinders 84 (see FIG. 9). Each cylinder 84 is pivotably connected at one end to a horizontal bar 86 affixed to the plate 56 and pivotably connected at another end to a respective vertical portion 68. When the cylinders 84 are extended, the vertical portions 68 are caused to slide horizontally along the beam 74 until the blocks 80 strike respective stops 82, whereupon further extension of the cylinders 84 causes the vertical portions 68 to pivot outwardly about the pins 70 as shown in broken lines in FIG. 9. That causes the horizontal portions 66 of the arms 64 to spread apart from one another.

In that way, a relatively wide spacing can be established between the horizontal portions 66 of the spread-apart lift arms 64 without having to make the vertical portions 68 excessively long.

Spacer plates 89 are mounted to respective ones of the vertical portions 68 and are oriented to engage one another when the lift arms are not extended (see FIG. 9), in order to define rest positions for the lift arms.

Figure 8:
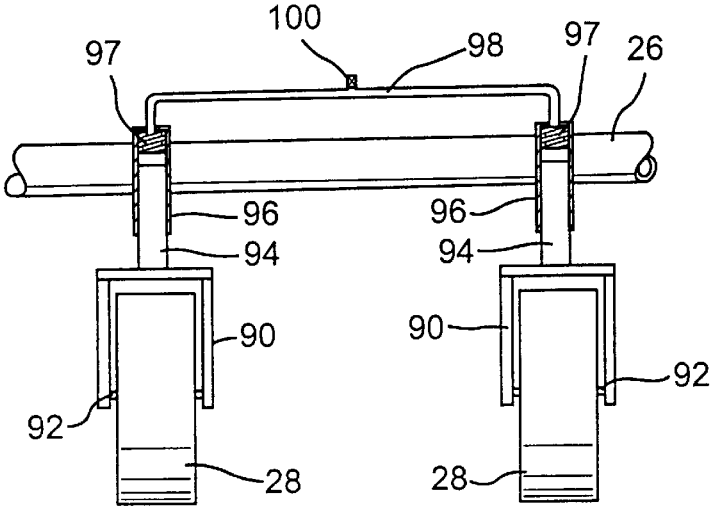
FIG. 8 is a rear elevational view of castor support wheels of the lift truck.

Returning to the castor wheels 28, it can be seen from FIG. 8 that the wheels 28 are mounted in yokes 90 by means of horizontal axles 92. Each yoke 90 carries a vertical post 94 that is rotatably mounted in a sleeve 96 carried by one of the transverse tubes 26. The posts 94 are biased downwardly by respective springs 97. The sleeves 96 carry hydraulic fluid and are fluidly interconnected by a conduit 98 in which a solenoid-actuated valve 100 is disposed. When the valve 100 is open, relative vertical movement between the wheels is permitted. That is, an upward movement of one wheel transfers fluid from its sleeve 96 to the other sleeve and produces an equal downward movement of the other wheel. When the valve is closed, no vertical movement of the wheels is permitted. The permitting of relative vertical movement between the castor wheels enables the vehicle to adapt to uneven terrain. By preventing the wheels from moving vertically, the truck becomes more stable when raising and lowering the lift arms.

Turning now to the latch arms 30 (FIG. 7), lower ends of the latch arms 30 are interconnected by the latch pin 31 which is adapted to engage a ground-mounted anchor in the form of a hook 104 mounted in concrete C embedded in the ground. A latching detector 106 is provided which detects when the stop pin 31 has properly engaged the hook 104. The detector 106 comprises a plate that is hinged at 108 to the latch arms 30 for rotation about a horizontal axis. A spring 110 biases the latch to a first position 106', wherein it is not visible to an operator seated in the cab 36. When the latch pin 31 engages the ground-mounted hook 104, the latching detector plate 106 is caused to pivot in a manner stretching the spring 110 and displacing a lower end of the plate rearwardly to a position in which it can be seen by the operator. Hence, the operator knows that the latching pin 31 has properly engaged the hook 104, because the plate 106 had not previously been visible from the operator's cab.

If desired, a separate electrical switch (not shown) could be provided which is actuated by the plate 106 to energize a signaling element (light or buzzer) in the operator's cab when a proper latching has taken place.

Figure 11:
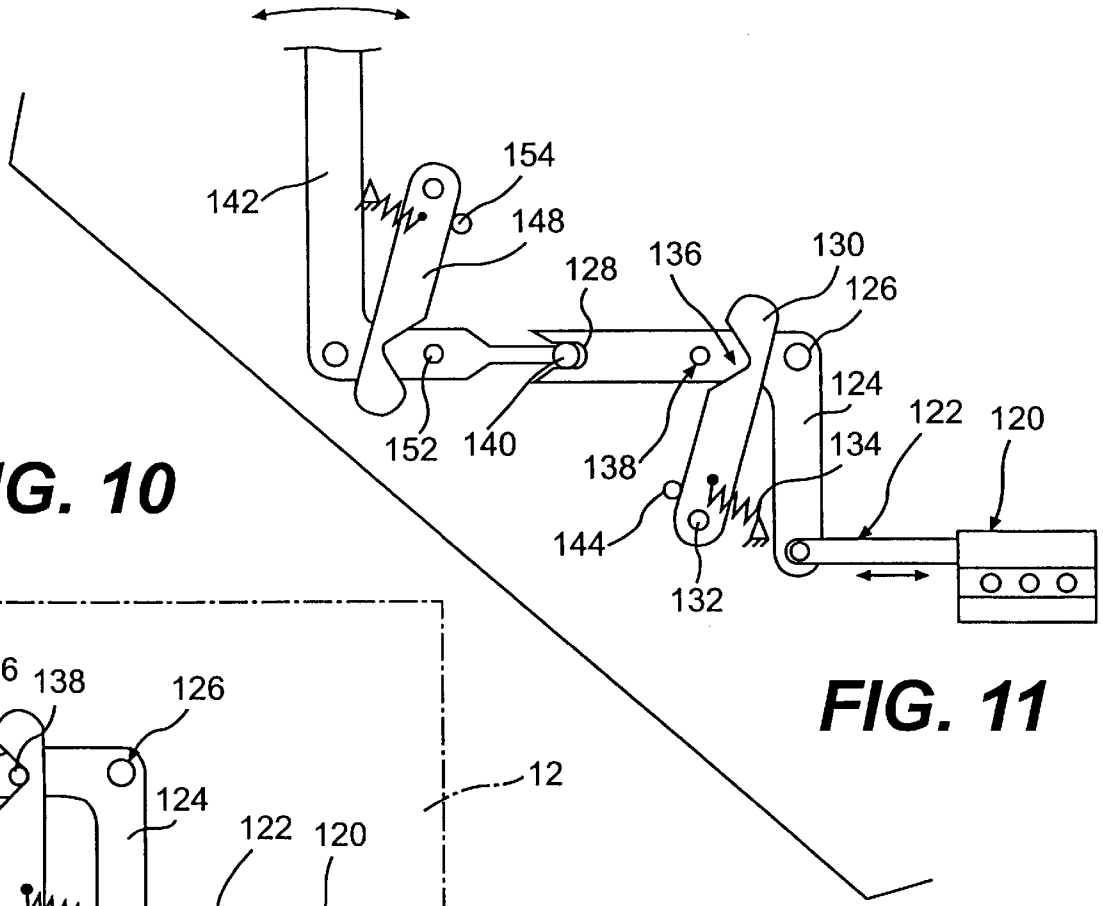
FIG. 11 is a view similar to FIG. 10 with the actuating mechanism in a coupled condition.
Figure 10:
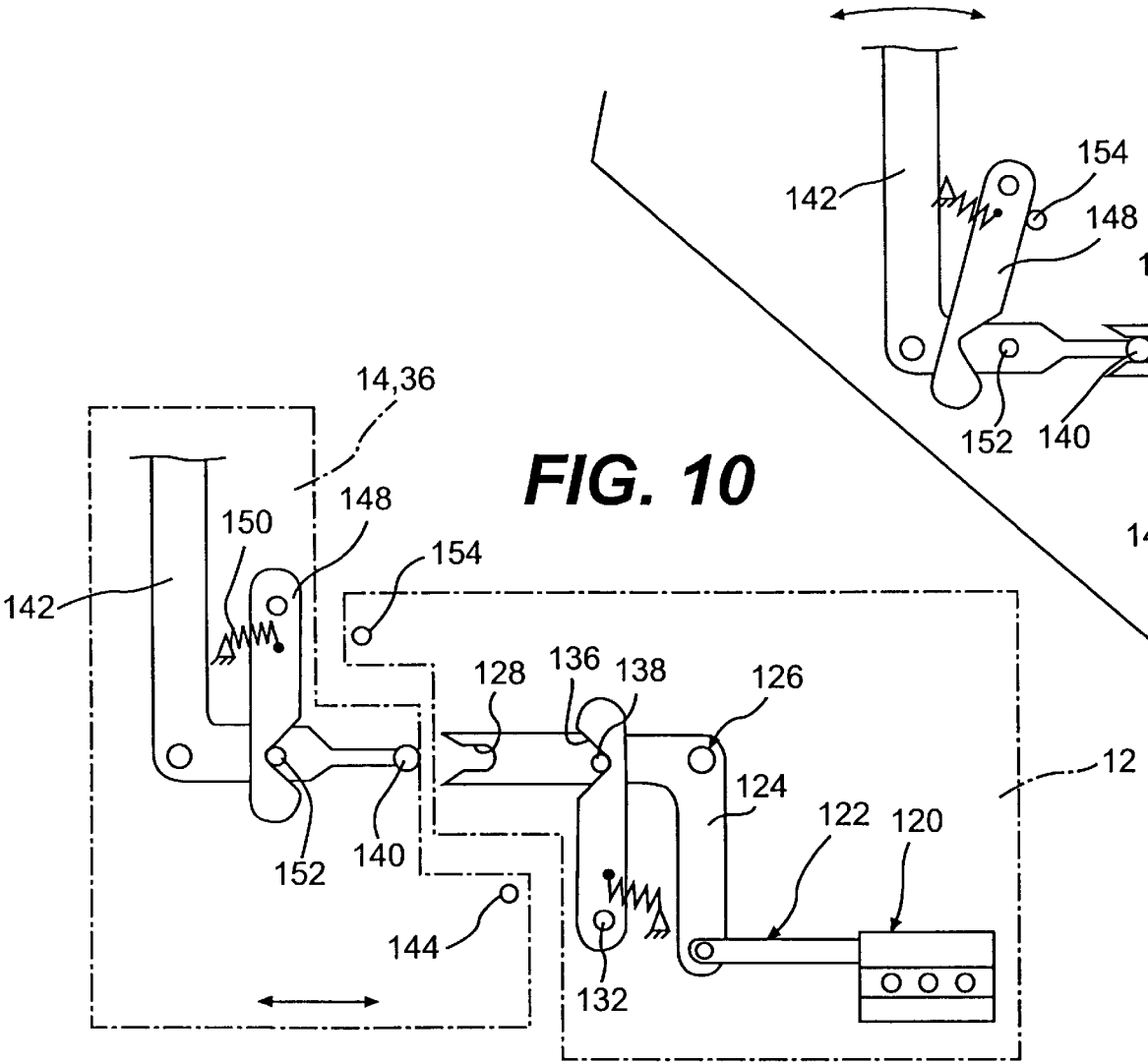
FIG. 10 is a schematic view of an actuating mechanism for the drive wheels, the actuating mechanism being in an uncoupled condition.

An important safety feature of the invention is the prevention of actuation of the drive wheels 22 when the mast and lift assembly 14, 16 are in their forward position (FIG. 2). That is accomplished by a mechanism depicted in FIGS. 10 and 11. FIG. 10 depicts a state wherein the mast 14 and cab 36 have been moved forwardly from a rearmost position, and FIG. 11 depicts a state wherein the mast 14 and cab 36 are in their rearmost position. FIG. 10 depicts, in phantom, the cab 36 and main frame 12 for the purpose of showing which of the parts of the safety mechanism are mounted thereon.

Depicted in FIGS. 10 and 11 is a hydraulic valve 120 which is mounted on the main frame 12 and is actuated by reciprocating an arm 122 to the right or left in FIG. 11. That arm is connected to one end of a first bell crank lever 124 which is rotatable about a stationary axle 126 and includes at its other end, a slot 128. Also mounted on the main frame 12 is a locking arm 130 which pivots about a pin 132 and is biased by a spring 134 to a position wherein a notch 136 of the locking arm 130 engages a projection 138 on the crank arm 124 to prevent rotation of the bell crank lever 124, whenever the mast 14 and cab 36 are out of a rearmost position, as shown in FIG. 10. In that state, the valve 120 cannot be actuated to energize the drive wheels 22.

When the mast and cab are in the rearmost position, an end 140 of a second bell crank lever 142 carried by the cab is received in the slot 128, and a projection 144 carried by the cab or mast pushes the locking arm 130 out of its locking position, permitting the first bell crank lever 124 to be rotated. The second bell crank lever 142 constitutes a manually actuable control arm which is pivoted by an operator to energize or de-energize one or both of the drive wheels 22 (i.e., by energizing only one of the drive wheels, a steering action is performed).

Whenever the cab and mast are out of their rearmost position, it is desirable that the second bell crank lever be positioned such that the end 140 thereof will automatically enter the slot 128 when the cab and mast return to their rearmost position. To that end, another pivoted locking arm 148 is provided which is mounted on the cab or mast and is biased by a spring 150 into locking engagement with a pin 152 affixed to the second bell crank lever 142, whereby the end 140 thereof is held in alignment with the slot 128.

When the cab and mast return to their rearmost position, the locking arm 148 is swung out of its locking position by a projection 154 carried by the main frame 12, as shown in FIG. 11, to allow the second bell crank lever 142 to pivot.

In operation of the above-described lift truck 10, it will be assumed that a boat (not shown) is floating adjacent the edge of the sea wall S, and that it is desired to remove the boat from the water and place the boat in a storage facility (not shown). The lift truck 10 is driven to the edge of the sea wall S as shown in FIG. 1, by driving the drive wheels 22. The mast 14 is in its rearmost position, whereby the bell crank levers 124 and 142 are coupled together, as shown in FIG. 11. This enables an operator seated in the cab 36 to swing the bell crank lever 142 (i.e., a manually rotatable control lever) for actuating the valve 120 and thereby controlling the drive wheels.

As the lift truck is driven to the sea wall, the valve 100 shown in FIG. 8 is in an open position for fluidly communicating the sleeves 96 with one another, to enable the posts 94 of the castor wheels 28 to move vertically relative to one another, thereby accommodating uneven ground surfaces. Upon reaching the sea wall, the valve 100 is closed to block communication between the sleeves, whereby vertical movement of the castor wheels 28 is prevented to stabilize the vehicle.

As the lift truck is moved to its final position at the sea wall, it is maneuvered to cause the latch plates 30 of the latch 29 to straddle an upper end of the ground-mounted hook 104, to ensure that the latch pin 31 travels beneath the upper horizontal portion of the hook and effect latching between the truck and the hook. As this occurs, the detector plate 106 is pivoted from its rest position 106' shown in broken lines in FIG. 7, to a displaced position shown in solid lines. Accordingly, the detector plate is now visible to the operator seated in the cab 36, whereby the operator knows that latching has taken place.

The operator now actuates the propulsion wheels 38 that are mounted on the mast 14 (one of the wheels 38 being shown in FIGS. 3 and 4), whereby the propulsion wheels travel along the respective tracks 40 to advance the mast 14 forwardly along the rails 46 of the main frame 12. As this occurs, the connection between the bell crank levers 124 and 142 is broken, as shown in FIG. 10, whereby accidental actuation of the drive wheels 22 is prevented.

Also, as the mast 14 travels forwardly, the center of gravity of the truck is displaced forwardly therewith. However, the truck is held stably in place by the connection between the latch 29 and the ground-mounted hook 104.

Once the mast 14 reaches its forward position (or possibly prior to forward movement of the mast 14, depending upon the size and shape of the boat to be lifted), the operator actuates the hydraulic system for extending the piston rods of the hydraulic cylinders 84 shown in FIG. 8 to horizontally displace the lift arms horizontally away from one another. As that occurs, the blocks 80 which carry the horizontal pins 70 (about which the lift arms rotate), are horizontally displaced along the slot 72 until contacting respective ones of the stops 82. The lift arms are now in the positions 64' shown in FIG. 9. By continuing to extend the hydraulic cylinders 84, the lift arms are caused to pivot about the axes defined by the pins 70 to positions 64" shown in broken lines in FIG. 9. The extent of this swinging movement will be sufficient to displace the horizontal portions 66 of the lift arms so that the lift arms can subsequently be lowered to a position whereby the horizontal portions 66 are situated beneath the boat. Then, the hydraulic cylinders 84 are retracted to reverse the above-described operation, whereby the horizontal portions 66 become positioned beneath the boat. Note that the lift arms can be displaced to any desired position along their path of travel, to ensure that the boat is optimally supported from beneath.

Then, the lift frame 50, together with the lift arms, are raised relative to the mast to lift the boat from the water. Subsequently, the operator actuates the propulsion wheels 38 to move the mast 14, together with the lift arms and boat, to a rearmost position shown in FIG. 1. Accordingly, the bell crank levers 124 and 142 become recoupled as shown in FIG. 11, whereby the operator is able to actuate the drive wheels 22. Those wheels are actuated in reverse to uncouple the latch 29 from the hook 104, enabling the lift truck to transport the boat to the storage facility.

When moving the mast 14 to the rearmost position, the weight of the boat becomes generally evenly distributed among the wheels 22, 28, whereby no counterbalancing is now necessary.

In accordance with the present invention, no counterbalancing weight is needed. Hence, the lift truck is lighter in weight and shorter in length. This results in less cost for manufacturing, shipping and handling of the trucks. Also, the pathways for the truck need not be as thick. Moreover, the aisles in the storage facility need not be as wide, so more space for boat storage becomes available.

Due to the ability of the lift arms to be displaced apart horizontally before being swung outwardly, the spacing between the horizontal portions of the lift arms is significantly increased without requiring that the vertical portions of the lift arms be lengthened.

The ability to deactivate the drive control for the drive wheels of the main frame whenever the mast is moved forwardly provides increased safety, because it insures that the truck cannot be transported until the weight of the lifted object is centered with respect to the ground support wheels (i.e., the risk of the truck tipping over forwardly is minimized).

The novel arrangement of the castor wheels provides one operation state in which the castor wheels can be moved vertically relative to one another to accommodate uneven terrain. However, by providing the option of preventing vertical movement of the castor wheels provides the truck with increased stability when a boat is being raised.

Figure 12:
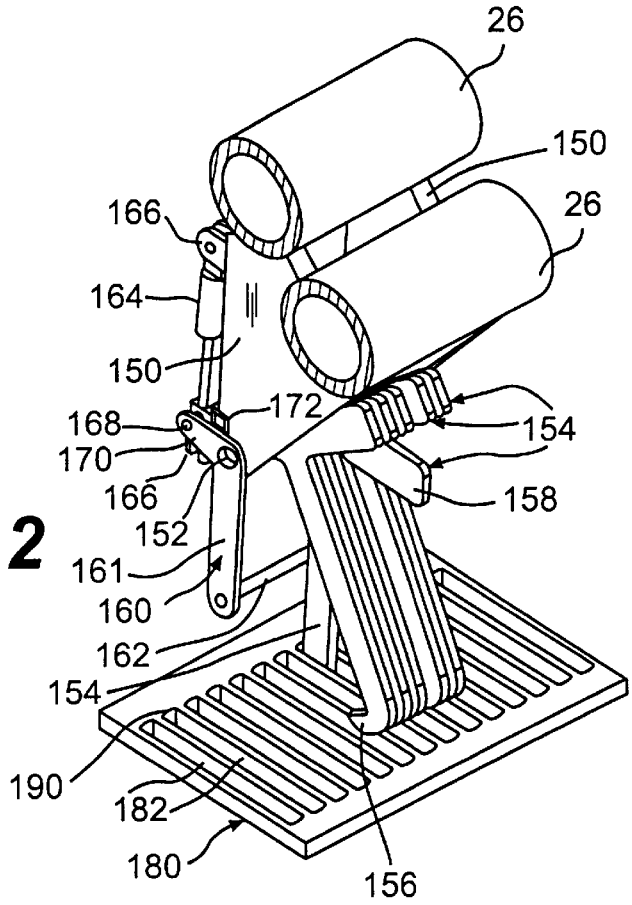
FIG. 12 is a perspective view of an alternative anchoring arrangement in an anchoring state.
Figure 13:
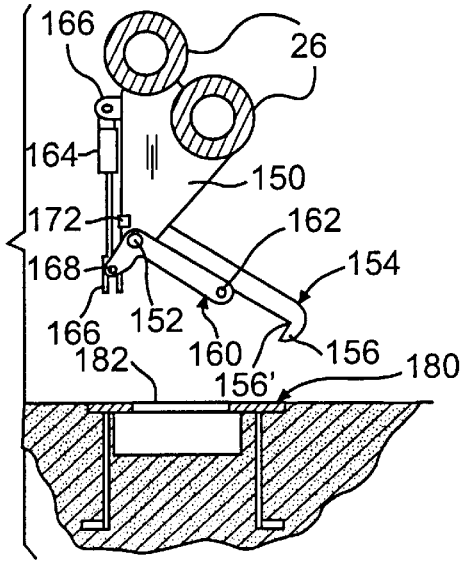
FIG. 13 is a side elevational view of the arrangement of FIG. 12 in a non-anchoring state.
Figure 14:
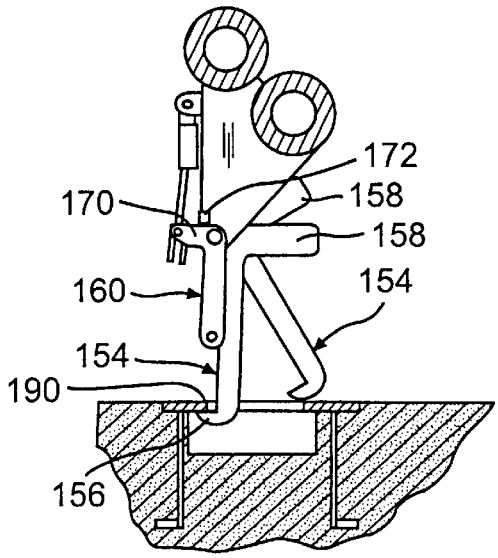
FIG. 14 is a view similar to FIG. 13 in an anchoring state.

An alternative latching arrangement is depicted in FIGS. 12–14, which eliminates the need for the permanently upstanding hook 104 which could present a tripping hazard if located in an area where people tend to walk. Depicted in FIG. 12 are two vertical plates 150 attached to the torsion tubes 26. Pivotably mounted to the plates by means of a pin 152 are two latching hooks 154. Each hook 154 includes a projection 156 at its lower end and a counterweight 158 at its upper end. The counterweight 158 biases its respective hook downwardly, the hooks being rotatable relative to one another.

A hook actuator arm 160 is provided for normally retaining the hooks in an upward position depicted in FIG. 13. The actuator arm 160 comprises a pair of crank levers 161 (only one shown in the drawing) interconnected by a bar 162 and pivoted to the plates 150 by means of the pin 152. A hydraulic cylinder 164 is pivotably mounted at its upper end to ears 166 affixed to one of the plates 150. A piston rod of the cylinder 164 carries an invested U-shaped yoke 166 into which projects a pin 168 that is mounted on a section 170 of the crank levers 161.

Disposed above the section 170 of the crank levers 161 is an electric switch 172 that is actuated by the section 170 of any of the hooks 154 disposed in its downward position. When actuated, the switch 170 permits the mast 14 to be driven forwardly by the main propulsion wheels 38. Until then, the mast cannot be so driven. For example, the switch could control a valve which blocks the flow of hydraulic fluid to motors of wheels 38.

The hooks 154 are designed to be operated in conjunction with an anchor in the form of a grid 180 that is anchored in the ground, e.g. anchored in the concrete C. The grid 180 includes a series of slots 182 oriented perpendicular to the seawall, i.e., oriented parallel to a direction of travel of the truck when approaching the seawall. The slots 182 are wider than each of the hooks 154.

In operation, the truck operator drives the truck to the seawall with the hooks 154 held in an upper or retracted state by the bar 162 of the actuator arm 160. The bar 162 is raised because the cylinder 164 is in an extended state. The operator maneuvers the truck so that the hooks 154 overlie the grid 180. It is preferable to provide a curb or other form of stop adjacent the seawall against which the drive wheels 22 will abut, to properly position the hooks relative to the grid 180 and eliminate the need for guesswork on the part of the operator.

At this point, the cylinder 164 is retracted, thereby raising the yoke 166 and enabling the actuator arm 160 and its bar 162 to swing downwardly under the urging of at least one of the weighted hooks 154. That is, since the grid 180 includes numerous slots 182, it is ensured that at least one of the hooks 154 will be aligned with a slot and thus be able to swing downwardly so that an upwardly facing catch portion 156' of the projection 156 becomes caught beneath a front edge 190 of the grid, as shown in FIGS. 12 and 14. Accordingly, the rear end of the truck will be firmly ground-anchored, and the switch 172 will be actuated to permit the mast to be driven forwardly by the propulsion wheels 38.

To release the hook(s) 154 the above-described steps are reversed.

The above-described swinging hooks 154 could be used in the event that one or more of the storage bays of the storage facility in which the boat is to be stored does not permit the main frame 12 of the truck to be received. That is, a normal storage bay enables a boat to be inserted or removed without having to extend the mast 14 forwardly, because the main frame 14 can travel into a space disposed beneath the bay. However, if such a space is not available, then it would be necessary to extend the mast in order to insert or remove a boat with respect to the storage bay. It would not be desirable that the floor of the storage facility have exposed hooks of the type shown in FIG. 7. Hence, the use of a grid 180 would be especially beneficial in such a case.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A lift truck comprising:

a self-propelled main frame having front and rear ends and including:

a pair of parallel horizontal rails extending in a fore-and-aft direction, ground support wheels for supporting the frame for travel along the ground, the ground support wheel including a pair of front ground support wheels disposed adjacent front ends of respective ones of the rails, and at least one rear ground support wheel located at a rear end of the main frame, a motor for driving at least one of the ground wheels, and a latch disposed adjacent a rear end of the main frame and including a catch portion, the latch arranged to extend downwardly such that the catch portion faces generally upwardly to grasp a ground-mounted anchor for anchoring the rear end of the main frame against upward movement;

a mast mounted on the rails for movement in a fore-and-aft direction along the rails, the mast being movable to a rearward position in which the mast is situated closer to the at least one rear ground support wheel than to the front ground support wheels, a first drive mechanism for propelling the mast forwardly and rearwardly along the rails;

a lift assembly mounted on the mast for vertical movement relative thereto, the lift assembly including a pair of lift arms having respective generally horizontal portions extending in the fore-and-aft direction; and a second drive mechanism for raising and lowering the lift assembly.

2. The lift truck according to claim 1 further including an operator's station mounted for fore-and-aft movement with the mast.

3. The lift truck according to claim 1 wherein the lift arms are rotatable together relative to the mast about a horizontal axis located rearwardly of front ends of the horizontal portions of the lift arms, the axis extending transversely relative to the fore-and-aft direction, and further including means for rotating the lift arms about the horizontal axis.

4. The lift truck according to claim 3 wherein each of the lift arms includes a generally vertical portion having a lower end connected to a respective one of the generally horizontal portions, the horizontal axis disposed adjacent the lower ends of the generally vertical portions.

5. The lift truck according to claim 1 wherein the latch comprises a pair of downwardly projecting plates and a pin extending between lower ends of the plates.

6. The lift truck according to claim 5 further including a detector mounted for movement in response to engagement of the pin with the ground-mounted anchor, to provide a visual indication of anchoring.

7. The lift truck according to claim 1 further including a detector for providing an indication of anchoring.

8. The lift truck according to claim 1 wherein the latch comprises a downwardly movable hook arranged to engage the ground-mounted anchor in the form of a grid having slots sized to receive the hook.

9. The lift truck according to claim 8 wherein there is a plurality of the hooks arranged for independent downward movement.

10. The lift truck according to claim 8 including means for holding the hooks upwardly and permitting the hooks to gravitate downwardly.

11. The lift truck according to claim 8 further including means for preventing the first drive mechanism from propelling the mast forwardly unless the hook is anchored to the grid.

12. A lift truck comprising:

a self-propelled main frame having front and rear ends and including:

a pair of parallel horizontal rails extending in a fore-and-aft direction, ground support wheels for supporting the frame for travel along the ground, the ground support wheels including a pair of front ground support wheels disposed adjacent front ends of respective ones of the rails, and at least one rear ground support wheel located at a rear end of the main frame, a motor for driving at least one of the ground support wheels, and a latch disposed adjacent a rear end of the main frame and arranged to extend downwardly and grasp a ground-mounted anchor for anchoring the rear end of the main frame;

a mast mounted on the rails for movement in a fore-and-aft direction along the rails;

a first drive mechanism for propelling the mast forwardly and rearwardly along the rails;

a lift assembly mounted on the mast for vertical movement relative thereto, the lift assembly including a pair of lift arms each having a generally horizontal portion extending in the fore-and-aft direction, each of the lift arms including a generally vertical portion swingable about a generally horizontal swing axis extending in a fore-and-aft direction, the lift arms being horizontally movable toward and away from one another for increasing and decreasing a distance between the swing axes, and means provided for rotating the lift arms about the horizontal swing axis; and a second drive mechanism for raising and lowering the lift assembly.

13. The lift truck according to claim 12 wherein the swing axes are disposed on horizontally slidable elements, an actuating mechanism connected to the lift arms at locations below the swing axes for displacing the slidable elements away from one another and into contact with respective stops for preventing further movement of the slidable elements and causing the lift arms to pivot away from one another about respective ones of the swing axes.

14. A lift truck comprising:

a self-propelled main frame having front and rear ends and including:

a pair of parallel horizontal rails extending in a fore-and-aft direction, ground support wheels for supporting the frame for travel along the ground, the ground support wheels including a pair of front ground support wheels disposed adjacent front ends of respective ones of the rails, and two rear ground support wheels located at a rear end of the main frame, the rear ground support wheels comprising castor wheels each having a vertical post mounted in a sleeve for vertical movement relative to the sleeve and for rotational movement relative to the sleeve about a vertical axis, a fluid conduit extending from an upper part of one sleeve to an upper part of the other sleeve and filled with liquid, the liquid being transferable from one sleeve to another to permit relative vertical movement of the castor wheels, and a valve provided for blocking liquid flow through the conduit to prevent upward movement of both castor wheels;

a motor for driving the front ground support wheels, and a latch disposed adjacent a rear end of the main frame and arranged to extend downwardly and grasp a ground-mounted anchor for anchoring the rear end of the main frame;

a mast mounted on the rails for movement in a fore-and-aft direction along the rails;

a first drive mechanism for propelling the mast forwardly and rearwardly along the rails;

a lift assembly mounted on the mast for vertical movement relative thereto, the lift assembly including a pair of lift arms each having a generally horizontal portion extending in the fore-and-aft direction; and a second drive mechanism for raising and lowering the lift assembly.

15. The lift truck according to claim 14 further including a spring in each sleeve for biasing the respective post downwardly.

16. A lift truck comprising:

a self-propelled main frame having front and rear ends and including:

a pair of parallel horizontal rails extending in a fore-and-aft direction, ground support wheels for supporting the frame for travel along the ground, the ground support wheels including a pair of front ground support wheels disposed adjacent front ends of respective ones of the rails, and at least one rear ground support wheel located at a rear end of the main frame, and a latch disposed adjacent a rear end of the main frame and arranged to extend downwardly and grasp a ground-mounted anchor for anchoring the rear end of the main frame;

a mast mounted on the rails for movement in a fore-and-aft direction along the rails;

an operator's station mounted for fore-and-aft movement with the mast;

a lift assembly mounted on the mast for vertical movement relative thereto, the lift assembly including a pair of lift arms each having a generally horizontal portion extending in the fore-and-aft direction; and a drive mechanism for raising and lowering the lift assembly;

wherein two of the ground support wheels constitute power driven drive wheels, and further comprising an actuating mechanism for energizing the drive wheels, a first part of the actuating mechanism mounted on the operator's station, and a second part of the actuating mechanism mounted on the main frame, whereby the first and second parts become uncoupled from one another in response to forward movement of the mast, to prevent the drive wheels from being energized.

17. The lift truck according to claim 16 wherein the second part includes a valve for controlling a flow of actuating fluid to the drive wheels, and a linkage for displacing a valve element of the valve; the first part including a control lever manually actuable by an operator, the control lever operably connectable to the linkage for transmitting movement of the control lever to the linkage, the control lever being disconnected from the linkage in response to forward movement of the mast.

18. The lift truck according to claim 17 further including first and second locking arms movable into engagement with the control lever and linkage, respectively, in response to disconnection thereof from the linkage to hold the control lever and linkage in a prescribed relationship to facilitate subsequent recoupling thereof, the first and second locking arms being displaceable out of locking relationship by portions of the main frame and mast, respectively, in response to the recoupling.

* * * * *